US008894519B2

(12) United States Patent
Young

(10) Patent No.: US 8,894,519 B2
(45) Date of Patent: Nov. 25, 2014

(54) AUTOMATIC OPENING MECHANICAL ARCHERY BROADHEAD

(71) Applicant: Paul A. Young, Wolfeboro, NH (US)

(72) Inventor: Paul A. Young, Wolfeboro, NH (US)

( * ) Notice: Subject to any disclaimer, the term of this patent is extended or adjusted under 35 U.S.C. 154(b) by 54 days.

(21) Appl. No.: 13/839,312

(22) Filed: Mar. 15, 2013

(65) Prior Publication Data

US 2014/0155202 A1 Jun. 5, 2014

Related U.S. Application Data

(60) Provisional application No. 61/731,657, filed on Nov. 30, 2012.

(51) Int. Cl.
*F42B 6/08* (2006.01)

(52) U.S. Cl.
CPC ..... *F42B 6/08* (2013.01)
USPC ..... 473/583

(58) Field of Classification Search
USPC ..... 473/583, 584
See application file for complete search history.

(56) References Cited

U.S. PATENT DOCUMENTS

| | | | | |
|---|---|---|---|---|
| 3,168,313 A | | 2/1965 | Lint | |
| 4,973,060 A | * | 11/1990 | Herzing | 473/583 |
| 6,044,832 A | | 4/2000 | Piersons, Jr. | |
| 6,258,000 B1 | | 7/2001 | Liechty, II | |
| 6,270,435 B1 | | 8/2001 | Sodaro | |
| 6,793,596 B1 | | 9/2004 | Sullivan et al. | |
| 6,830,523 B1 | | 12/2004 | Kuhn | |
| 7,713,151 B2 | | 5/2010 | Fulton | |
| 7,717,814 B1 | | 5/2010 | Sanford | |
| 7,905,802 B2 | | 3/2011 | Erhard | |
| 8,007,382 B1 | | 8/2011 | Sanford | |
| 8,043,177 B2 | * | 10/2011 | Flanagan | 473/583 |
| 8,096,905 B1 | | 1/2012 | Gillig | |
| 8,105,187 B1 | * | 1/2012 | Sanford | 473/583 |
| 8,210,970 B1 | * | 7/2012 | Sanford | 473/583 |
| 8,287,407 B1 | | 10/2012 | Sanford | |
| 8,313,399 B2 | * | 11/2012 | Sanford | 473/583 |
| 8,393,983 B1 | * | 3/2013 | Sanford | 473/583 |
| 2010/0113196 A1 | | 5/2010 | Jones | |

* cited by examiner

*Primary Examiner* — John Ricci
(74) *Attorney, Agent, or Firm* — McLane, Graf, Raulerson & Middleton, Professional Association

(57) ABSTRACT

Archery broadheads include one or more cutting blades which are folded in when shot from a bow. The blades deploy automatically using stored potential energy upon impact with minimal interaction with the target. The blades are attached to the main body of the broadhead and pivot near the leading or forward edge. The deployment is caused by a plunger tip cam releasing the stored potential energy of an internal spring mechanism and uses only minimal kinetic energy of the arrow to actuate. According to one exemplary embodiment, once actuated, the internal spring slides along a cam shaped part of the blades forcing them open. According to another exemplary embodiment, once actuated, the internal spring operates a slide connecting a toggle-link to the blades forcing them open. In both embodiments, the spring-slide mechanism holds the blades closed during flight, deploys the blades on contact and locks the blades open.

20 Claims, 6 Drawing Sheets

AUTOMATIC OPENING MECHANICAL ARCHERY BROADHEAD

CROSS-REFERENCE TO RELATED APPLICATION

This application claims priority to U.S. Provisional Application No. 61/731,657 filed Nov. 30, 2012. The aforementioned provisional application is incorporated herein by reference in its entirety.

TECHNICAL FIELD

The present disclosure relates to archery equipment in the area of arrow points with razor edged cutting blades sometimes called broadheads, and more particularly to improved mechanical broadheads utilizing an internal spring to provide both a holding force to keep the blades in a closed position closed during flight and an opening force to urge the blades to an open position when the broadhead impacts a target.

BACKGROUND

There are two general types of broadheads used today: fixed blade and mechanical opening blades. Fixed blade types are those where the cutting blades are rigidly mounted to the main shaft while mechanical broadheads generally fly with moveable blades in the closed position and the blades are opened by interacting with the desired target. While many designs are known to be effective at producing the desired effect of dispatching quarry, a major drawback to fixed blade designs is that they do not fly as accurately or precisely as similar weight practice or target points. The archer will spend time practicing and tuning their equipment to achieve a level of confidence using arrows tipped with non-broadhead type target tips only to find that when the broadheads are attached to the same arrow shafts, the arrows fly differently. The aerodynamics of most fixed blade broadheads differs significantly from target or field points so the archer must then re-adjust all their settings to compensate for the change in impact point accuracy or loss of precision. In some cases, acceptable accuracy cannot be achieved at all.

With the advent of mechanical broadheads, most of the accuracy re-adjustments disappeared. Since the mechanically deployed blades remain retracted completely or at very low profile during flight, the aerodynamics are very similar to target points. In most cases and with most designs, the archer has to make small or no adjustments to their equipment to switch over to hunting broadheads after practice tips. However, as with most solutions designed to solve one problem, a host of other negative issues were found to go along with the positive effects.

The first issue with mechanical broadheads is the decrease in energy associated with using mechanically deployed blades. Most of the mechanical broadheads currently patented and available for use have blades that use the forward momentum or kinetic energy of the flying arrow in order to open them. Generally, upon impact to the target, some part of the closed blade makes contact with the animal and forces the blades to open by some sort of sliding or pivoting action. This can significantly diminish the effectiveness of the arrow as the energy loss used in opening the blades means less energy available for penetrating the target.

Another issue with mechanical broadheads is that they are unreliable. They can open prematurely during arrow flight, which causes havoc with accuracy resulting in missed or poorly hit quarry. Many methods and patents relate to providing a reliable means of keeping the moving blades closed during flight and yet somehow ensuring the blades are able to open on impact.

A third major issue with mechanical broadheads is that they may not open when needed. There may not be enough kinetic energy left in the arrow to cause them to open for instance. The angle of incidence to the quarry might cause only one blade to open or even cause the arrow to miss the quarry completely when the blades pivot open. The blades may become entangled in the quarry's fur/hair before engaging proper substance resulting in the blades not operating as intended.

Due to these and other inherent flaws in the current mechanical designs, many archers have not embraced the mechanical broadheads as a viable solution to the fixed broadhead shortcomings. In fact, some state's game management practices established by their governing game departments do not allow the use of mechanical broadheads at all. It is for these reasons that a more reliable and efficient idea was needed.

The present disclosure provides improved mechanical archery broadheads that solves the issues related to using fixed blade designs and eliminates the problems created by the current designs of mechanically deployed blades.

REFERENCES

The following references relate to the field of the disclosure:

U.S. Pat. No. 7,717,814, issued May 18, 2000, entitled EXPANDABLE ARROW BROADHEAD WITH SPRING BIASED SLIDING SHAFT AND POINTED TIP, discloses a mechanical broadhead with an internal spring. However, the internal spring is used only to detain the blades in the closed position and does not help to open the blades on impact. In fact, the spring actually compresses further upon impact, thus absorbing more of the arrows kinetic energy, which is a negative effect.

U.S. Patent Application Publication No. 2010/0113196, published May 6, 2010, entitled ARCUATELY EXPANDABLE MECHANICAL BROADHEAD, discloses a broadhead that is claimed to be automatically opening, but which does not use a spring to actuate the blades. Instead, it uses very thin, flexible, and flimsy blades wrapped around a central shaft that claim to open themselves upon impact. The blades are held in place around the arrowhead by another spring and not deployed by that spring as the proposed design is. The net result is that the design lacks the rigidity to cause the damage necessary to dispatch an animal humanely.

U.S. Pat. No. 8,007,382, issued Aug. 30, 2011, entitled, EXPANDABLE ARROW BROADHEAD WITH TWO-PIECE FOLDING CUTTING BLADES, discloses a broadhead with a linked blade arrangement that opens on impact. An internal spring is used only to hold the blades in the retracted closed position and does not assist with their opening. The spring actually compresses during impact absorbing more kinetic energy, which is a negative feature.

U.S. Pat. No. 6,044,832, issued Jan. 31, 2012, entitled ARROW BROADHEAD WITH PIVOT ARMS FOR RETRACTING AND EXTENDING ATTACHED CUTTING BLADES, discloses a mechanical broadhead with a linkage design to push the blades open upon impact, the opening force is derived from forceful contact with the target and not an internal energy source such as a spring. The internal spring is used to hold the blades in the retracted position and does not assist with their opening. The spring actually compresses during impact absorbing more kinetic energy, which is a negative feature.

U.S. Pat. No. 7,713,151, issued May 11, 2011, entitled MECHANICAL BROADHEAD WITH EXPANDABLE BLADES, discloses a broadhead which uses internal wire springs, but they are only used to hold the blades in the closed position and do not assist with the opening process.

U.S. Pat. No. 6,830,523, issued, Dec. 14, 2004, entitled MECHANICAL BROADHEAD ARROWHEAD, discloses a broadhead using an internal spring to retain the blades in the retracted position and acts as an inertial trigger releasing the blades from the locked position caused by the rapid deceleration of the arrow as it impacts the target. It also promotes the deployment of the blades but does not cause the complete opening/deployment and locking of the blades as do the broadheads of the present disclosure. It merely starts them while the key opening force is due to the blades interacting with the target and thereby reducing the kinetic energy of the system.

U.S. Pat. No. 6,270,435, issued Aug. 7, 2001, entitled ARROWHEAD, discloses an arrowhead using an internal spring to force blades back along a camming surface during impact. However, there is no triggering effect as with the arrowheads of the present disclosure. An annular ring retains the blades in a refracted position during flight and must completely slide off of the blades before they can be free to move outward. Since the only way the ring can move is by interference or friction with the intended target, the blades are not free to deploy until the broadhead has completely entered the target. The problem is then that the broadhead is now inside of the target and the target itself will deter the blades from opening.

U.S. Pat. No. 7,905,802, issued Mar. 15, 2011, entitled EXPANDING, EXPOSED-BLADE ARROW HEAD, discloses an arrowhead with an axial spring that used to hold the blades closed and does not assist with opening. The spring actually compresses during impact absorbing more kinetic energy, which is a negative feature.

U.S. Pat. No. 6,258,000, issued Jul. 10, 2001, entitled PENETRATION ENHANCING AERODYNAMICALLY FAVORABLE ARROWHEAD, discloses an arrowhead design that uses an axial spring to hold the expandable blades in a retracted position and in a deployed position. However, the blades are opened by contacting the target material and forcing them back and the spring does not assist with blade opening.

U.S. Pat. No. 3,168,313, issued Feb. 2, 1965, entitled HUNTING ARROWHEAD WITH RETRACTABLE BARBS, discloses an arrowhead design having an internal spring that is used to allow a retractable barb (not a cutting blade) to move out of the way as the tip enters the target. It does not open the barbs upon impact but will try to re-open them once the arrow tip has passed into the target and closed the barbs as it entered.

U.S. Pat. No. 8,096,905, issued Jan. 17, 2012, entitled ARCHERY BROADHEAD WITH REPLACEABLE BLADES, discloses an arrowhead containing a spring but the spring is only used to retain the fixed blades and allows a quick change system for replacing those blades. It is a fixed blade design only.

U.S. Pat. No. 6,793,596, issued Sep. 21, 2004, entitled ARROWHEAD WITH PIVOTABLE BLADES, discloses a mechanical arrowhead that uses a spring system, but the spring system is used only to retain the moveable pivoting blade in the closed and open position and does not force the blade to open.

U.S. Pat. No. 8,287,407, issued Oct. 16, 2012, entitled ARROW BROADHEAD WITH PIVOT ARMS FOR RETRACTING AND EXTENDING ATTACHED CUTTING BLADES, discloses an arrowhead which uses a linkage system attached to the blades and an internal sliding collar, but which still relies on the kinetic inertia to actuate and open the blades and not an internal spring. It also specifies a rubber band to hold the blades closed during flight. In addition, the blades are attached to the sliding tip and not the fixed body of the broadhead.

By reading historical literature on the subject, examining the existing patents, and reviewing the current designs available to archers, a complete picture can be painted of where the related art has progressed. It is generally known in the archery industry and to those experienced in the sport of archery that arrowheads using sharpened cutting blades have a greatest effect of causing lethal damage to an animal. Going all the way back to the stone age, arrows tipped with some sort of sharpened stones provided the best means dispatching one's quarry. Over the years, as technology advanced, sharpened, metallic, fixed-blade tipped arrows were developed and became favored over the stone types.

When modern archery came about in the mid 1900's, the fixed metallic broadhead design was still prevalent. While many improvements were made to the bow such as going from straight limbs to recurve, and then to compound bows in the latter 1900's, arrows began to fly much faster. Fast arrows offered more available kinetic energy and also a flatter trajectory that extended the effective range of the archer hunting his quarry. However, it soon became obvious that broadheads with large fixed blades did not follow the pure mathematical trajectory curves they were theoretically supposed to. At high speed, the aerodynamic effects were seen to cause erratic flights to arrows, which actually decreased the effective accuracy range of the bowhunter. Fast arrows that were not accurate or precisely controlled offered no advantage to slow and accurate ones. One solution to this problem was to simply make the broadhead blades smaller in size as well as make them more aerodynamically sound. While this helped, the bow designs continued to set new records for arrow speed and the erratic flight problem continued to pervade the flight equation. Plus, a very small cutting blade diameter diminished the lethal effect of the arrow on the quarry.

A more elegant solution was invented in the mid to late 1900's with the design and development of the mechanical broadheads. This concept provided blades that moved from a low profile or closed position that was ideal for flying at high velocity to an open position as it entered the target animal that maximized the cutting effect and therefore the killing ability of the arrow. To date there are many designs of mechanical broadheads. However, many concepts of them have been found to be very unreliable and have become extinct. Even the current commercially marketed designs are a subject for heated debate throughout the hunting community. Many states have outlawed all mechanical broadheads for hunting due to the question of unreliability.

The issue of unreliability centers around the fact that under certain conditions, the closed blades fail to open. In such a case, minimal cutting and killing effect is imposed on the intended quarry, resulting in a wounded or maimed animal which could suffer unnecessarily. While inventors, designers, and archery broadhead manufacturers have worked diligently to overcome the potential unreliability of mechanical broadhead designs, they have not completely eliminated the risk of a non-opening event. Even the "best" designs that are used and endorsed extensively by bowhunters are known to have the possibly of not opening under certain angles or without enough kinetic energy. Some are also known to occasionally open prematurely and change the point of impact during flight.

A solution to these problems is to eliminate the target as the sole means of opening the closed broadhead blades. The broadheads of the present disclosure do not use the target to directly and forcibly open the closed cutting blades. Instead, they use the target to initiate a mechanism that then uses internal potential spring energy to deploy the cutting blades. No matter what the angle of incidence between the arrow and the target, the tip is the only part that needs to contact the animal. The blades then open automatically using the stored potential energy from within the broadhead. Once deployed, the blades are locked in place and the broadhead acts just as a fixed blade design with a full cutting edge.

SUMMARY

In one aspect, an arrow broadhead adapted for attachment to an end of an arrow shaft includes a main body having an axial bore adjacent a forward end of the main body, a first counterbore adjacent the axial bore, and a second counterbore adjacent the first counterbore. A first cam follower is slidably received within the first counterbore and a second cam follower is slidably received within the second counterbore. A shaft is slidably received within the axial bore, the shaft having a first end attached to the first cam follower and a second end attached to a pointed tip. The pointed tip is disposed exteriorly of the main body at the forward end of the main body. A plurality of cutting blades are pivotally attached to the main body, each cutting blade having an outward facing cutting edge and an inward facing cam edge, each cutting blade pivotal between an open position and a closed position at the leading end of the blade. The cam edge is defined by a first angled cam, a second angled cam, and a sear notch. Each cutting blade extends through a longitudinal slot in the main body, wherein the first angled cam extends into the first counterbore and the second angled cam extends into the second counterbore when the cutting blades are in the closed position. The first angled cam is configured to pivot the cutting blade to an intermediate position between the closed position and the open position responsive to rearward movement of the first cam follower. The second angled cam is configured to pivot the cutting blade to the open position responsive to forward sliding movement of the second cam follower. A spring includes a first end exerting a force against the second cam follower. When the cutting blades are in the closed position, the second cam follower exerts a force against the sear notch to secure the cutting blades in the closed position. When the cutting blades are in the intermediate position, the second cam follower exerts a force against the second cam surface to urge the cutting blades to the open position.

In another aspect, an arrow broadhead adapted for attachment to an end of an arrow shaft, the broadhead includes a main body having an axial bore adjacent a forward end of the main body, a first counterbore adjacent the axial bore, and a second counterbore adjacent the first counterbore. A cam follower is slidably received within the first counterbore. A shaft is slidably received within the axial bore, with a first end attached to the cam follower and a second end attached to a pointed tip, the pointed tip being disposed exteriorly of the main body at the forward end of the main body. A plurality of cutting blades are pivotally attached to the main body, each cutting blade having an outward facing cutting edge and an inward facing cam edge, the cam edge having an angled cam, each cutting blade pivotal between an open position and a closed position at the forward end of the blade. Each cutting blade extends through a corresponding longitudinal slot in the main body, wherein the angled cam extends into the first counterbore. A slide is slidably received in the second counterbore. For each cutting blade, a toggle link has a first end pivotally attached to the cutting blade and a second end pivotally attached to the slide. The toggle link is pivotable through a range of movement between a first over center position and a deployed position. A spring has a first end exerting a force against the slide, the spring exerting biasing force to secure the cutting blades in the closed position when the toggle link is in the first over center position. The angled cam is configured to pivot the cutting blade and move the toggle link out of the first over center position responsive to rearward movement of the cam follower. When the toggle link is moved out of the first over center position, the spring exerts a biasing force to pivot the cutting blade to the open position responsive to forward sliding movement of the slide within the second counterbore.

The automatic opening broadheads of the present disclosure are based on a mechanical opening concept, having two or more moving blades, but use an internal energy source to move the blades from the closed position to the open position upon impact. The preferred energy source is a stressed compression or extension spring which has stored potential energy. The internal spring first provides the holding force to keep the blades closed during flight. When these broadheads impact a target, a very small amount of energy is required to release the stored potential energy resulting in a very rapid opening of the cutting blades. In principle, the tip acts as a trigger moving a sear and unleashing the stored energy, which opens the retracted blades instantly. Because the majority of the energy used to open the blades comes from within the broadhead, the maximum kinetic energy of the arrow is maintained and available for transfer to the target resulting in the most severe cutting effect for the blades. This optimizes the efficiency of the broadhead, coming very close to that of fixed blade designs.

The arrowheads of this disclosure provide the advantages that mechanical broadheads offer over the fixed blade types, such as improved aerodynamics, precision and accuracy, while reducing or eliminating some of the negative issues associated with current forced-open mechanical broadheads.

By using an internal energy source, the problems related to current mechanical designs may be reduced or eliminated. One advantage of the proposed design over existing mechanical broadheads is improved retention of an arrow's kinetic energy. This means that either existing draw weight bows will transfer more energy to the quarry resulting in a more humane death or that lower draw weight bows can be used to achieve the same net effect. This could enable more archers with less physical strength to engage in the bowhunting sport. Young adults, women, and physically challenged people who were previously unable to partake in the outdoor sports of archery hunting would now be able to effectively hunt as well as the physically stronger people.

Another advantage of the present disclosure resides in its improved reliability over existing mechanical designs. Since the blades open automatically upon impact, they do not need a forceful interaction with the surface of the quarry as with existing designs. The tip needs only to make contact with the target to cause the stored energy within the broadhead to deploy the blades. This happens at such as high rate of speed that essentially, the broadhead acts as a fixed blade design when it enters the quarry achieving all the known benefits of the fixed blade broadheads.

Another advantage of the presently disclosed design is its ability to be operated as a fixed broadhead in the event that the archer desires or regulations require that only fixed blade designs be used. The blades can be manually deployed by pressing in the tip and then the blades are fully extended and locked in the open position and ready to fire in an instant. The archer needs only one design of broadhead for all circumstances.

Figure 1:
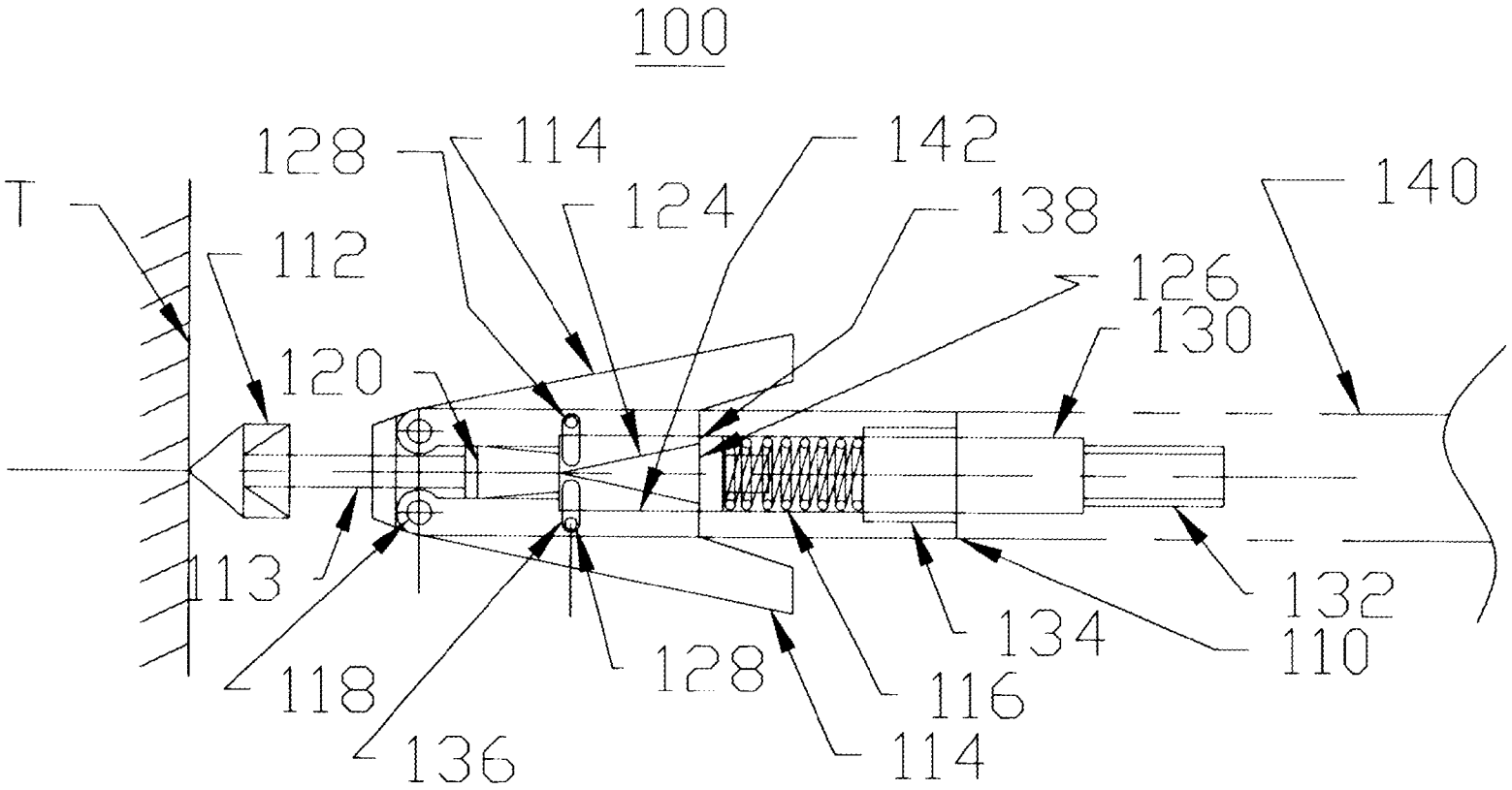
FIG. 1 shows a side view of a first preferred broadhead embodiment of the present disclosure with the blades locked in the retracted or closed position. The same spring that stores the energy used to deploy the blades is also used to ensure the blades stay closed during arrow flight. The spring applies force to an overlapping sear engagement surface between the blades and the large cam follower, keeping the blades locked in the closed position.
Figure 2:
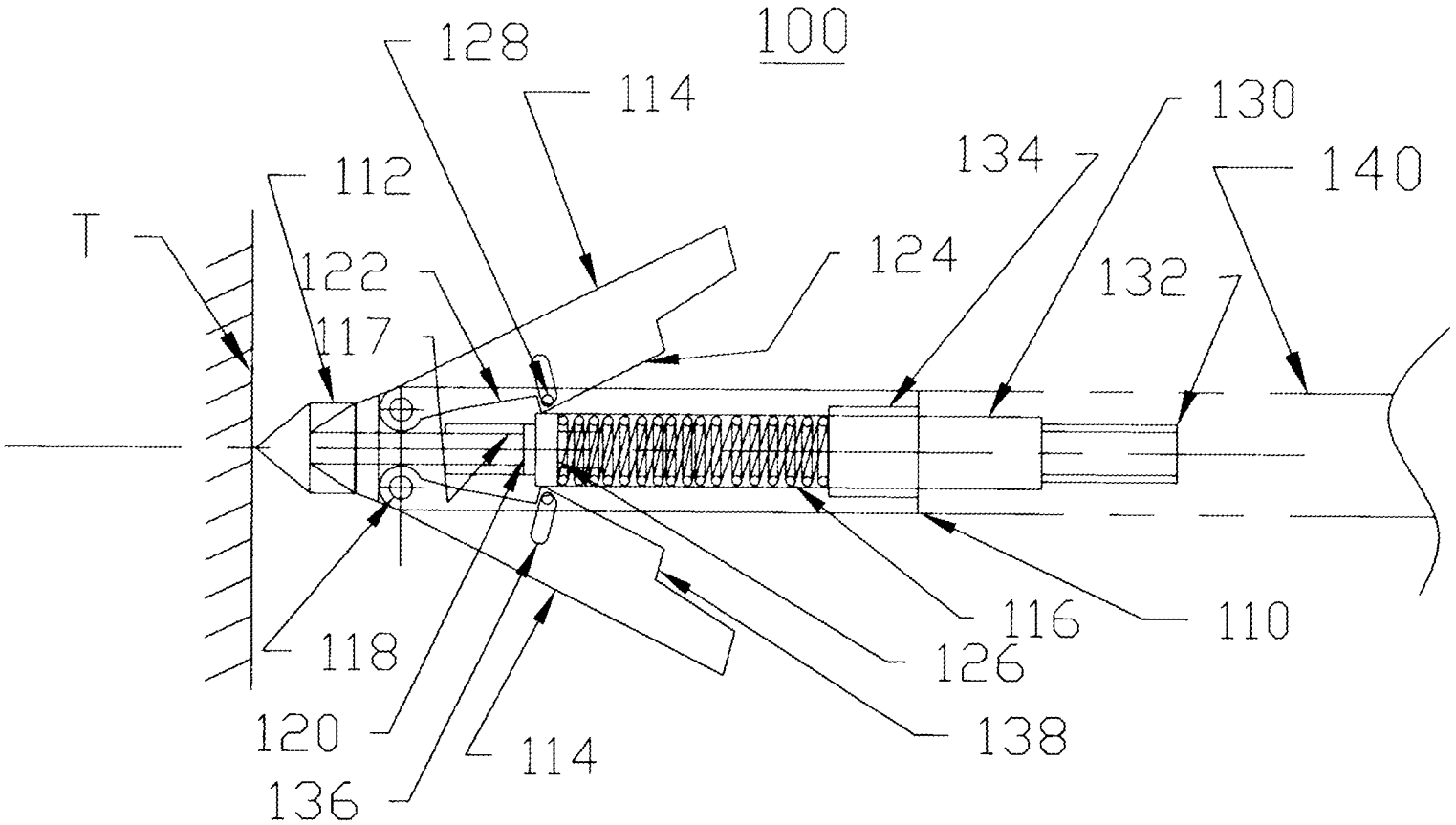
FIG. 2 shows the embodiment appearing in FIG. 1, but with the internal energy released and the cutting blades deployed to their maximum extent. The plunger tip pushes a small sliding cam follower along the cam surface of the blade, moving it just off of the sear engagement notch. Once off of the notch, the spring takes over forcing a larger sliding cam follower forward along another camming surface on the blade and opens the blades. The cam also provides another locking surface preventing the blades from closing again and hence becomes a fixed blade broadhead upon deployment.
Figure 3:
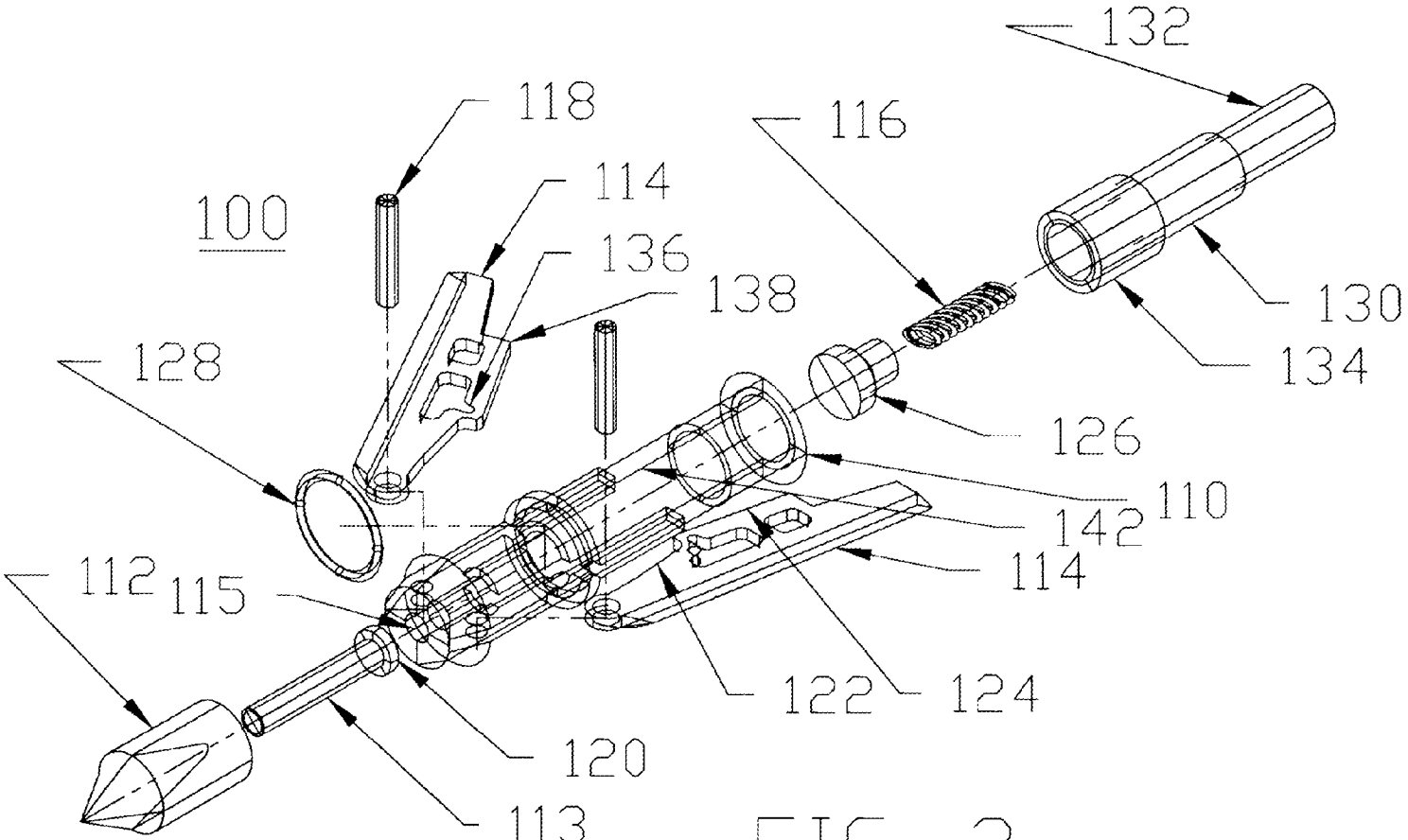
FIG. 3 is an exploded view of the embodiment appearing in FIG. 1.

The following are the parts defined in FIGS. 1-3:

100 is the first embodiment arrowhead herein;

110 is the broadhead body or ferrule;

112 is the plunger tip;

113 is the connecting rod between the pointed tip 112 and small cam follower 120;

114 is the flat sharpened cutting blade;

115 is the axial bore in the body 110;

116 is the compressed spring that applies the locking force and the opening force to the blades 114;

117 is the first counterbore in the body 110;

118 is the blade pivot pin or screw fastener where the blade attaches the body 110;

120 is the plunger cam follower that initiates the spring opening of the blades;

122 is the small angled camming surface of the blades 114;

124 is the large angled cam surface on the blades 114;

126 is the large cam follower that opens the blades 114;

128 is a stop pin (or alternatively, an annular ring) used to set the maximum opening of the blades 114;

130 is the threaded fastener that attaches the broadhead 100 to the arrow shaft 140;

132 is the first threaded end of the fastener 130;

134 is the second threaded end of the fastener 130;

136 is a slot in the blade 114 that limits blade maximum opening;

138 is the sear notch engagement surface of the blade 114;

140 is the arrow shaft;

142 is the second counterbore in body 110;

T is the target.

Figure 4:
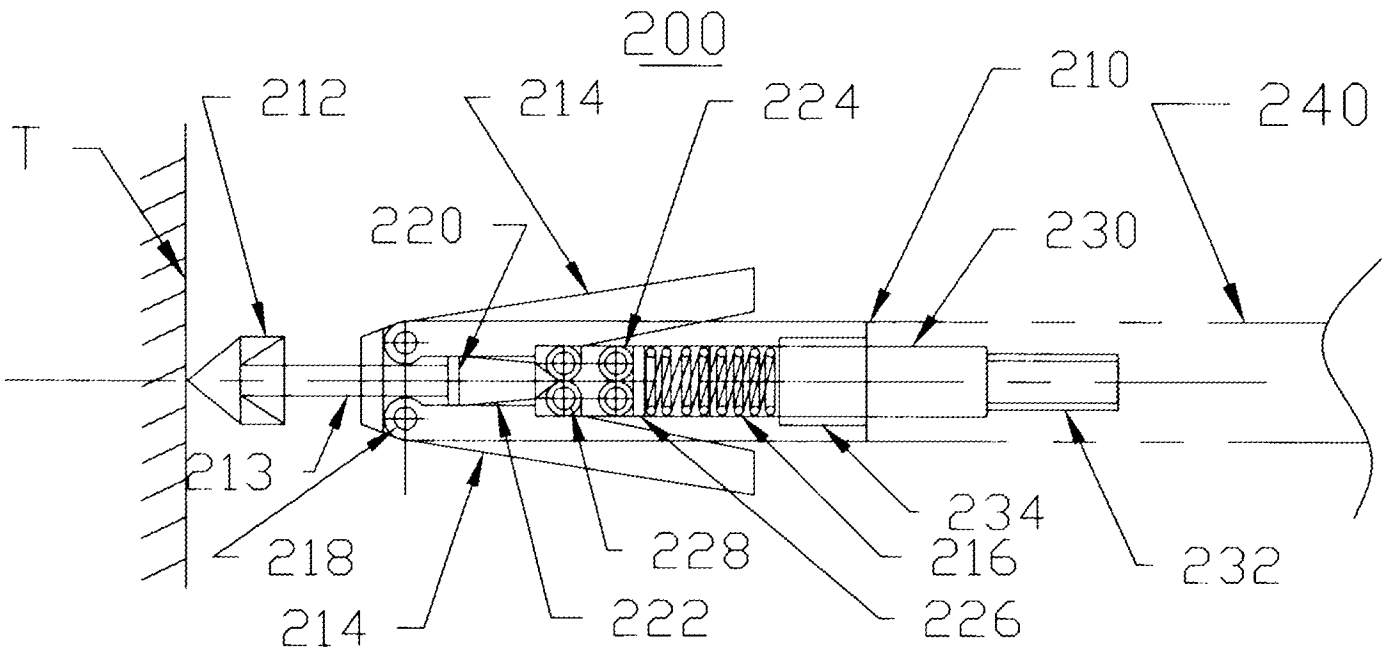
FIG. 4 shows a side view of a second preferred broadhead embodiment of the present disclosure with the blades locked in the retracted or closed position. The same spring that stores the energy used to deploy the blades is also used to ensure the blades stay closed during arrow flight. The spring applies force to a toggle-link that is geometrically "over center" and holding the blades in the closed position.
Figure 5:
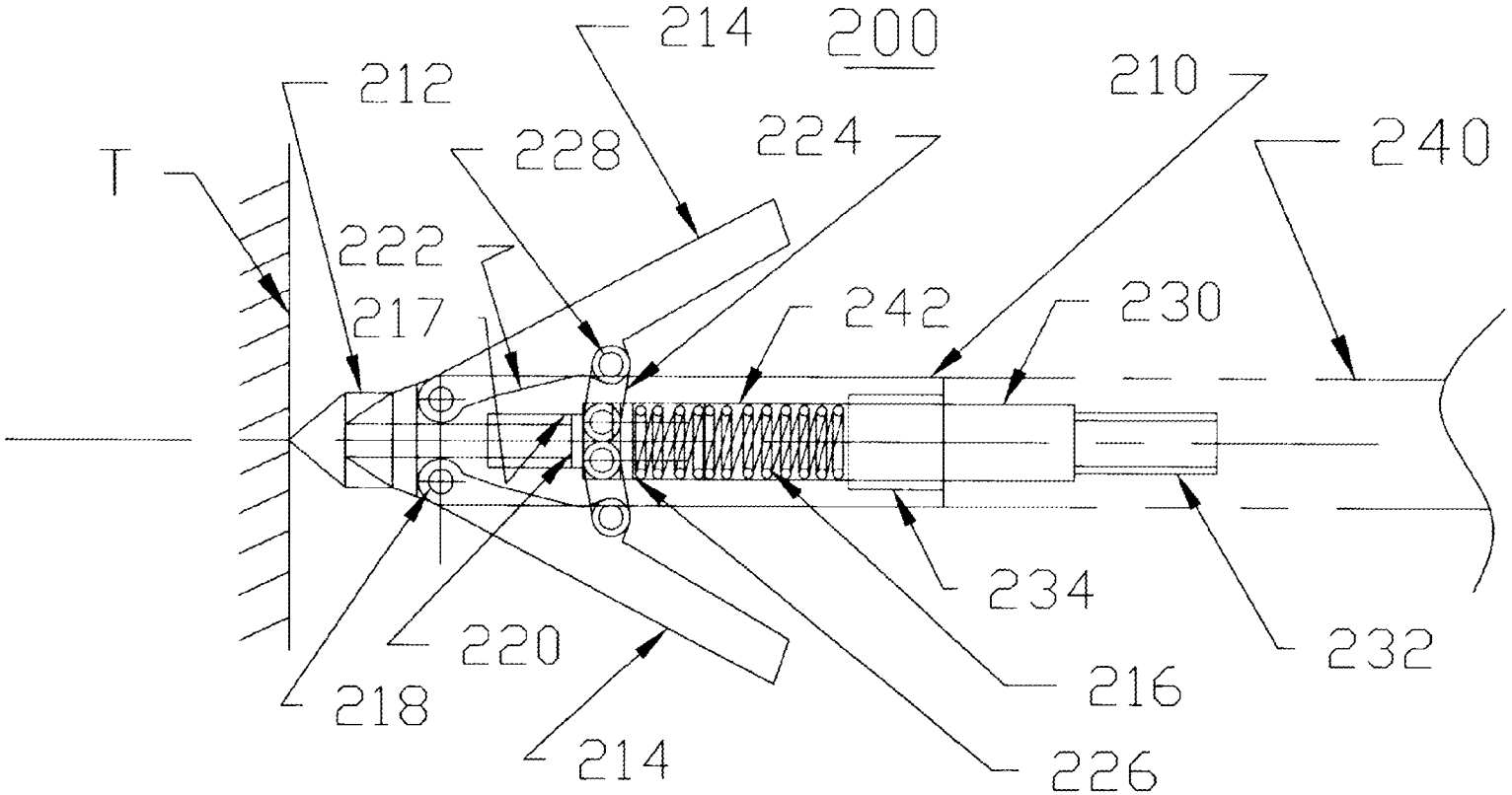
FIG. 5 shows the embodiment appearing in FIG. 4, but with the internal energy released and the cutting blades deployed to their maximum extent. In this view, the plunger tip has been pushed into the main body or ferrule pushing the cam sliding down the cam surface of the blades. After a very small amount of force and movement, the toggle linkage is brought "over center" the other way allowing the spring to release all of its stored energy. The toggle links force the blades out to their fully locked position as the slide moves to its final state at the end of the counterbore in the ferrule. In this final state, the links are also locked "over center" so any force applied to the cutting surface of the blades will not be able to close them again. In essence, this becomes a fixed blade broadhead after deployment.
Figure 6:
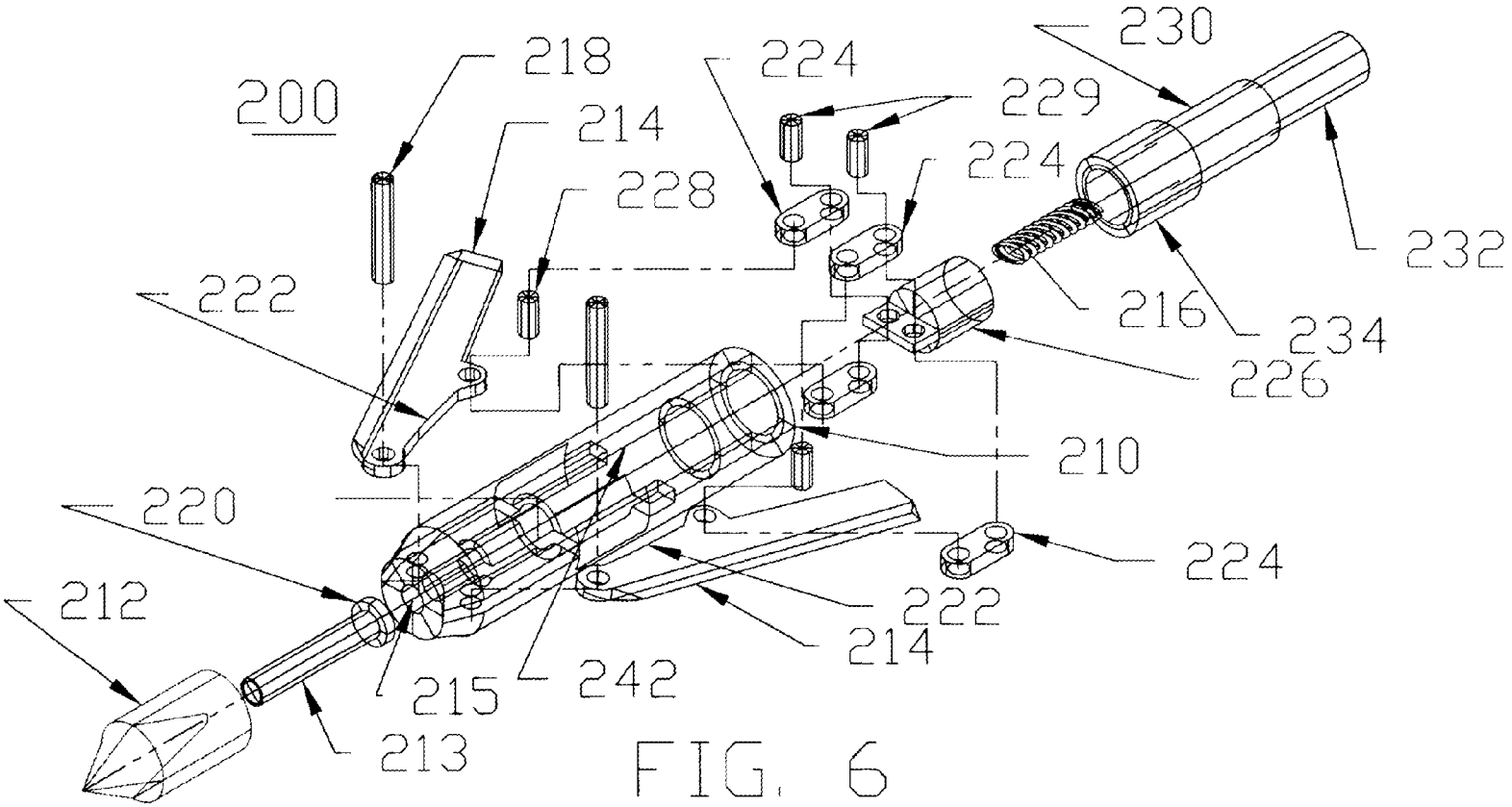
FIG. 6 is an exploded view of the embodiment appearing in FIG. 4.

The following are the parts defined in FIGS. 4-6:

200 is the second embodiment arrowhead herein;

210 is the broadhead body or ferrule;

212 is the plunger tip;

213 is the connecting rod between the pointed tip 212 and the cam follower 220;

214 is the flat sharpened cutting blade;

215 is the axial bore in the body 210;

216 is the compressed spring that applies the locking force and the opening force to the blades 214;

217 is the first counterbore in the body 210;

218 is the blade pivot pin or screw fastener where the blade attaches the body 210;

220 is the plunger cam follower that initiates the spring opening of the blades;

222 is the angled camming surface of the blades 214;

224 is a toggle linkage that connects the slide 226 to the blade 214;

226 is the slide;

228 is the pivot pin and attachment point for the toggle linkage 224 to the blade 214;

230 is a threaded fastener that attaches the broadhead 200 to the arrow shaft 236;

232 is the first threaded end of the fastener 230;

234 is the second threaded end of the fastener 230;

240 is the arrow shaft;

242 is the second counterbore in body 210;

T is the target.

DETAILED DESCRIPTION OF THE PREFERRED EMBODIMENTS

Referring to FIGS. 1-3, FIG. 1 shows the first embodiment broadhead 100 ready to launch. The broadhead 100 is attached to an arrow shaft 140 via a threaded fastener 130, which may include a first male threaded end 132, which engages a complimentary female threaded insert on the arrow shaft 140. The first threaded fastener end 132 and complimentary insert on the shaft 140 may be based on an industry standard design. The opposite end 134 of the threaded fastener 130 is also threaded for removable attachment to the rearward end of the main body 110 of the arrowhead 100, for example, via male threads on the fastener end 134 which engage female threads in the rearward end of the main body 110.

The exemplary broadhead 100 shown herein has two blades 114 mounted 180 degrees opposed to each other. In alternative embodiments, other numbers of blades can be employed. For example, the arrowhead 100 could be adapted to provide three blades spaced 120 degrees apart, four blades spaced 90 degrees apart, and so forth. The blades 114 are shown in the closed and locked position in FIG. 1. In this state, the compressed spring 116 exerts a force between the large cam follower 126 and the sear notch surface 138 of each blade 114, thereby holding the blades 114 in the closed or retracted position. When the depicted embodiment 100 is in the closed position, a portion of the cutting blade 114 extends beyond the outer diameter of the main body 110. In alternative embodiments, the cutting blade 114 is configured to be received completely within the main body 110 when in the closed position or flush with the outer diameter of the main body 110 when in the closed position.

FIG. 2 shows the broadhead 100 with the blades 114 in the deployed and locked position. FIG. 3 is an exploded view of the broadhead 100. A pointed tip 112 is disposed at the forward end of the main body 110. The tip 112 is coupled to a first cam follower 120 via a rod 113. The rod 113 is slidably received within an axial bore 115 in the body 110. The first cam follower 120 is slidably received within a first counter bore 117 in the body 110.

In operation, the arrow flies until the tip 112 contacts an intended target T. The plunger tip 112 then slides into the arrowhead body 110, moving the small cam follower 120 along the angled surface 122 of the blades 114. The camming angle is relatively shallow in the illustrated embodiment, such that minimal sliding force and distance are required to move the blade sear notch 138 from its locked position on the large cam follower 126 to the free position. Once the sear engagement notch 138 has moved far enough to allow the large cam follower 126 to slide along the large angled cam surface 124 of the blade 114, the spring 116 takes over and forces the blades 114 to open to the maximum amount allowed by the slot 136 and the stop pin 128. Alternatively, the stop member 128 could be a circumferential ring (see FIG. 3), such as a wire ring. The spring 116 is preferably designed or selected to ensure that it exerts a sufficient force on the large cam follower 126 to keep the large cam follower 126 in the end of the second counterbore 142 in the ferrule 110. As shown in FIG. 2, the blades 114 are locked in place by the side of the large cam follower 126 and work just as a fixed blade broadhead enabling them to cut to the maximum strength of the blade material.

In an alternative embodiment, the stop pins/ring 128 can be removed or eliminated, as well as the slots 136, thus allowing the blades 114 to pivot freely about its respective pivot point 118 after opening. In this configuration, the blades 114 will still be constrained from closing by the cam follower 126, which is urged against the shoulder of the second counterbore 142 by the spring 116, as the broadhead enters the target T. However, the blades 116 will fold forward about the pivot axes 118 when the arrow is removed from the game animal. For example, some states' regulations may prohibit a "barbed" or undercut condition between the blade 116 and the body 110 so when operated in this way, the alternative embodiment is compliant with these states as well.

In order to reset the broadhead 100 to the ready position so it can be used again, the threaded end 134 can be removed from the body 110 to remove all of the spring energy within the broadhead 100. The large cam follower 126 can then be brought back to the ready position. The blades 114 can then be folded back against the body 110, e.g., by manually pivoting the blades 114 about the respective pivot pins 118. The spring 116 is then re-compressed as the fastener end 134 is re-inserted into the body 110. In alternative embodiments, an access slot, such as an elongated, axially-extending slot, may be provided in the body 110 or access hole through the threaded fastener 134 to allow a tool to be inserted to slide back the cam follower 126 in the rearward direction to compress the spring 116 and allow the blades 114 to be folded in to the closed or retracted position without the need to remove the fastener 130 from the arrowhead body 110.

Referring now to FIGS. 4-6, there appears a second exemplary embodiment broadhead 200. FIG. 4 shows the broadhead 200 with the blades in the closed or retracted position, ready to launch and FIG. 5 shows the broadhead 200 with the blades in the open or extended position. FIG. 6 is an exploded view of the broadhead 200.

The arrowhead 200 is attached to an arrow shaft 236 using via a threaded fastener 230, e.g., a threaded fastener having first threaded end 232, which engages a complimentary female threaded insert on the arrow shaft 240. The threaded fastener end 234 may be based on an industry standard. The opposite end of the fastener 230 is removably attached to the rearward end of the arrowhead body or ferrule 210, e.g., via male threads on the end 234 engaging female threads in the rearward end of the arrowhead body 210.

The exemplary embodiment 200 shown has two blades 214 mounted 180 degrees opposed to each other but it will be recognized that other numbers of blades, for example, three blades spaced 120 degrees apart, four blades spaced 90 degrees apart, etc. In FIG. 3, the blades 214 are shown are in the closed and locked position. The compressed spring 216 exerts a force axially to a slide 226 slidably received in a second counter bore 242. Each blade 214 has a pivoting linkage comprising one or more toggle links 224, each having a front end pivotally attached to the blade 214 via pivot pins 228 and a second end pivotally coupled to the slide 226 via pivot pins 229. In the closed position, the blade pivot point 228 is locked in an over center condition relative to the pivot points 218 and 229. The pivot pin 228 is geometrically out of alignment with the blade pivot 218 and the slide pivot 229, and will remain locked until some force is applied perpendicular to the axial direction the linkage 224.

When the depicted embodiment 200 is in the closed position, a portion of the cutting blade 214 extends beyond the outer diameter of the main body 210. In alternative embodiments, the cutting blade 214 is configured to be received completely within the main body 210 when in the closed position or flush with the outer diameter of the main body 210 when in the closed position.

FIG. 5 depicts the broadhead 200 with the blades in the deployed and locked position. A pointed tip 212 is disposed at the forward end of the main body 210. The tip 212 is coupled to a cam follower 220 via a rod 213. The rod 213 is slidably received within an axial bore 215 in the body 210. The cam follower 220 is slidably received within a first counter bore 217 in the body 210.

In operation, the arrow flies until the tip 212 contacts the intended target T. The plunger tip 212 then slides into the body 210, moving the cam follower 220 along the angled surface 222 of the blades 214. The camming angle of the blade surface 222 may be made relatively shallow so that minimal sliding force and distance is required to move the blades 214 from the closed and locked position shown in FIG. 3 back over center.

Once the toggle link 224 has moved to the free position, the spring 216 pushes the slide 226 all the way up the second counterbore 242 of the ferrule 210 and forces the blades 214 to the open position. At full spring extension, the links 224 have moved over center again, thus locking the blades 214 in the fully extended position. The spring 216 may be designed or selected such that once in the open position, there is still sufficient force to hold the slide 226 against the shoulder of the second counterbore 242 in the ferrule 210, maintaining the blades 214 in the locked, open condition. In the open position, the blades 214 are locked in place and work just as a fixed blade broadhead enabling them to cut to the maximum strength of the blade material.

In alternative embodiments, the pivot point of each blade 214 receiving the pivot member 228 can be designed with a notch or partial circular (e.g., semi-circular) cutout in the blade 214 instead of a full closed opening receiving the pivot pin 228. In such alternative embodiments, upon opening, the blades 214 will be free to pivot about the pin 218 but will still be constrained from closing by the toggle linkage 224. In this configuration, the blades 214 will still be locked from closing as the broadhead enters the target T, but will fold forward upon arrow removal from the game animal. Some states' regulations currently prohibit a "barbed" or undercut condition between the blades 214 and the body 210 so when operated in this way, the alternative embodiment is compliant with these states as well.

In order to reset the broadhead 200 to the ready (i.e., closed, locked) position so it can be used again, the threaded end 234 can be removed from the body 210 to remove all of the spring energy within the broadhead 200. The slide 226 can then easily be retracted and the links 224 will swing into the body 210. As the links 224 fold inward, the blades 214 will be folded back against the body 210 manually. The spring is then re-compressed as the fastener end 234 is re-inserted into the body 210. In alternative embodiments, an access slot can be provided in the body 210 or an access hole through the fastener 234 and a tool engaging the slide 226 through the access point can be used to move the slide 226 rearward, compressing the spring 216 so the blades 214 can be folded in.

While there have been shown and described what are at present considered to be the preferred embodiments of the invention, it will be apparent to those skilled in the art that various changes and modifications can be made herein without departing from the scope of the invention defined by the appended claims. Therefore, it is intended that all matter contained in the above description or shown in the accompanying drawings shall be interpreted as illustrative and not in a limiting sense.

What is claimed is:

1. An arrow broadhead adapted for attachment to an end of an arrow shaft, the broadhead comprising:

a main body having an axial bore adjacent a forward end of the main body, a first counterbore adjacent the axial bore, and a second counterbore adjacent the first counterbore;

a first cam follower slidably received within said first counterbore;

a second cam follower slidably received within said second counterbore;

a shaft slidably received within the axial bore, the shaft having a first end attached to the first cam follower and a second end attached to a pointed tip, the pointed tip disposed exteriorly of the main body at the forward end of the main body;

a plurality of cutting blades pivotally attached to said main body, each cutting blade having an outward facing cutting edge and an inward facing cam edge, each cutting blade pivotal at the forward end between an open position and a closed position;

said cam edge defined by a first angled cam, a second angled cam, and a sear notch;

each cutting blade extending through a longitudinal slot in the main body, wherein said first angled cam extends into said first counterbore and said second angled cam extends into said second counterbore when the cutting blades are in the closed position;

said first angled cam configured to pivot the cutting blade to an intermediate position between the closed position and the open position responsive to rearward movement of the first cam follower;

said second angled cam configured to pivot the cutting blade to the open position responsive to forward sliding movement of the second cam follower;

a spring having a first end exerting a force against the second cam follower;

when the cutting blades are in the closed position, said second cam follower exerting a force against the sear notch to secure the cutting blades in the closed position; and when the cutting blades are in the intermediate position, said second cam follower exerting a force against the second cam surface to urge the cutting blades to the open position.

2. The broadhead of claim 1, wherein said pivot pins are disposed adjacent the forward end of the main body.

3. The broadhead of claim 1, wherein each cutting blade includes an elongate slot and further comprising a stop member running in the elongate slot to limit the range of pivoting movement of the cutting blade.

4. The broadhead of claim 3, the stop member is selected from a pin or circumferential ring of wire traversing each longitudinal slot and an annular stop member passing through each longitudinal slot and elongate opening.

5. The broadhead of claim 1, wherein said spring includes a second end bearing against the closed end of a threaded coupler which is attached to the arrow shaft.

6. The broadhead of claim 1, wherein the plurality of cutting blades includes 2 cutting blades.

7. The broadhead of claim 1, wherein the plurality of cutting blades includes 2-4 cutting blades.

8. The broadhead of claim 1, wherein a portion of the cutting blades remains exposed outside the main body when the cutting blades are in the closed position.

9. The broadhead of claim 1, wherein the spring is configured to store sufficient potential energy to lock the cutting blades in the open position when the blades are moved to the open position.

10. The broadhead of claim 1, further comprising:

a threaded coupler having a first threaded end adapted for attaching to a rearward end of the main body and a second threaded end adapted to attach to a threaded end of a hollow arrow shaft.

11. The broadhead of claim 1, wherein the second cam interacts with the second cam follower to lock the blades in the fully open position.

12. An arrow broadhead adapted for attachment to an end of an arrow shaft, the broadhead comprising:

a main body having an axial bore adjacent a forward end of the main body, a first counterbore adjacent the axial bore, and a second counterbore adjacent the first counterbore;

a cam follower slidably received within said first counterbore;

a shaft slidably received within the axial bore, the shaft having a first end attached to the cam follower and a second end attached to a pointed tip, the pointed tip disposed exteriorly of the main body at the forward end of the main body;

a plurality of cutting blades pivotally attached to said main body, each cutting blade having an outward facing cutting edge and an inward facing cam edge, said cam edge having an angled cam, each cutting blade pivotal between an open position and a closed position;

each cutting blade extending through a corresponding longitudinal slot in the main body, wherein said angled cam extends into said first counterbore;

a slide slidably received in said second counterbore;

for each cutting blade, a toggle link having a first end pivotally attached to the cutting blade and a second end pivotally attached to the slide, said toggle link pivotable through a range of movement between a first over center position and a deployed position;

a spring having a first end exerting a force against the slide, said spring exerting biasing force to secure the cutting blades in the closed position when the toggle link is in the first over center position;

said angled cam configured to pivot the cutting blade and move the toggle link out of the first over center position responsive to rearward movement of the cam follower; and when the toggle link is moved out of the first over center position, said spring exerting a biasing force to pivot the cutting blade to the open position responsive to forward sliding movement of the slide within the second counterbore.

13. The broadhead of claim 12, wherein said spring includes a second end bearing against the closed end of a threaded coupler which is attached to the arrow shaft.

14. The broadhead of claim 12, wherein the plurality of cutting blades includes 2 cutting blades.

15. The broadhead of claim 12, wherein the plurality of cutting blades includes 2-4 cutting blades.

16. The broadhead of claim 12, wherein a portion of the cutting blades remains exposed outside the main body when the cutting blades are in the closed position.

17. The broadhead of claim 12, wherein a portion of the cutting blades remains exposed outside the main body when the cutting blades are in the closed position.

18. The broadhead of claim 12, wherein the spring is configured to store sufficient potential energy to lock the cutting blades in the open position when the blades are moved to the open position.

19. The broadhead of claim 12, further comprising:

a threaded coupler having a first threaded end adapted for attaching to a rearward end of the main body and a second threaded end adapted to attach to a threaded end of a hollow arrow shaft.

20. The broadhead of claim 12, wherein the toggle link deployed position is a second over center position serving to lock the cutting blades in the open position.

* * * * *